US008863731B2

(12) United States Patent
Chen

(10) Patent No.: US 8,863,731 B2
(45) Date of Patent: Oct. 21, 2014

(54) SLINGSHOT SEAT

(76) Inventor: Samuel Chen, Shanghai (CN)

( * ) Notice: Subject to any disclaimer, the term of this patent is extended or adjusted under 35 U.S.C. 154(b) by 225 days.

(21) Appl. No.: 13/410,491

(22) Filed: Mar. 2, 2012

(65) Prior Publication Data

US 2013/0140861 A1 Jun. 6, 2013

Related U.S. Application Data

(60) Provisional application No. 61/566,445, filed on Dec. 2, 2011.

(51) Int. Cl.
*A63B 71/00* (2006.01)

(52) U.S. Cl.
USPC ..... 124/17

(58) Field of Classification Search
CPC ..... A63B 21/0552; A63B 2210/50; A63B 2210/02; A47C 9/002; A47C 3/021; A47C 3/025
USPC ..... 124/17, 20.1; 472/135; 482/85
See application file for complete search history.

(56) References Cited

U.S. PATENT DOCUMENTS

| | | | | |
|---|---|---|---|---|
| 567,915 | A * | 9/1896 | McLarty | 4/541.1 |
| 1,899,255 | A * | 2/1933 | Bell | 482/96 |
| 5,303,695 | A * | 4/1994 | Shopsowitz | 124/17 |
| 6,811,217 | B2 * | 11/2004 | Kane et al. | 297/270.2 |

* cited by examiner

*Primary Examiner* — Gene Kim
*Assistant Examiner* — Amir Klayman
(74) *Attorney, Agent, or Firm* — Clement Cheng

(57) ABSTRACT

A slingshot seat has a frame with a rocker bottom configured to provide a low trajectory and a high trajectory. A seat is mounted on the frame and positioned to allow a user to rock forward on the rocker bottom to a forward position of the low trajectory and positioned to allow a user to rock backward on the rocker bottom and a backward position of the high trajectory. A pair of upwardly extending arms extend from the frame. The pair of upwardly extending arms terminate in a right upper end and a left upper end. An elastic cord is attached to the right upper end and attached to the left upper end. A pocket is mounted on the elastic cord between the right upper end and the left upper end.

9 Claims, 5 Drawing Sheets

SLINGSHOT SEAT

This application claims priority from United States provisional application entitled Slingshot Seat by inventor Samuel Chen, filed Dec. 2, 2011 having provisional application No. 61/566,445, the disclosure of which is incorporated herein by reference.

FIELD OF THE INVENTION

The present invention is in the field of slingshot launching structures.

DISCUSSION OF RELATED ART

A variety of different launchers have been created for launching balls and grenades with a slingshot structure. For example, U.S. Pat. No. 2,367,249, issued Jan. 16, 1945 to Walker provides a grenade thrower slingshot having a receptacle for receiving a grenade and a pair of stirrups for attaching to boots, the disclosure of which is incorporated herein by reference. Stirrups can also be handheld handles, such as described in Magnuson D305,342 entitled elastic sling missile launcher toy, issued Jan. 2, 1990, the disclosure of which is incorporated herein by reference.

Other inventors have found that using a frame structure provides improved range. Peachey in U.S. Pat. No. 5,249,564 describes a soccer ball projecting apparatus, the disclosure of which is incorporated herein by reference. The soccer ball projecting apparatus has a receptacle for holding a soccer ball and a frame for retaining a soccer ball slingshot. Carlson U.S. Pat. No. 5,398,665 issued Mar. 21, 1995 describes a ball launching device having a fold up triangular pyramid frame for suspending a ball slingshot, the disclosure of which is incorporated herein by reference. Jakubec in U.S. Pat. No. 6,851,675 describes a launching game apparatus, which includes a shield for deflecting incoming projectiles. The shield support is attached to the frame, which also supports the slingshot.

SUMMARY OF THE INVENTION

A slingshot seat has a frame with a rocker bottom configured to provide a low trajectory and a high trajectory. A seat is mounted on the frame and positioned to allow a user to rock forward on the rocker bottom to a forward position of the low trajectory and positioned to allow a user to rock backward on the rocker bottom and a backward position of the high trajectory. A pair of upwardly extending arms extend from the frame. The pair of upwardly extending arms terminate in a right upper end and a left upper end. An elastic cord is attached to the right upper end and attached to the left upper end. A pocket is mounted on the elastic cord between the right upper end and the left upper end.

The slingshot seat may also have a foot rest connected to the frame between the pair of upwardly extending arms. The seat can be a blow molded plastic member. A pair of end caps can be fitted, namely a left end cap and a right end cap. The left end cap fits over the left upper end and the right end cap fits over the right upper end. The pocket can have a pull strap for pulling back the net pocket. The pair of upwardly extending arms can be continued so that they bend backward and connect to the tubular frame. The seat can be a blow molded plastic member. The upwardly extending arms can form a pair of arches when continued so that they bend backward and connect to the tubular frame.

Figure 1:
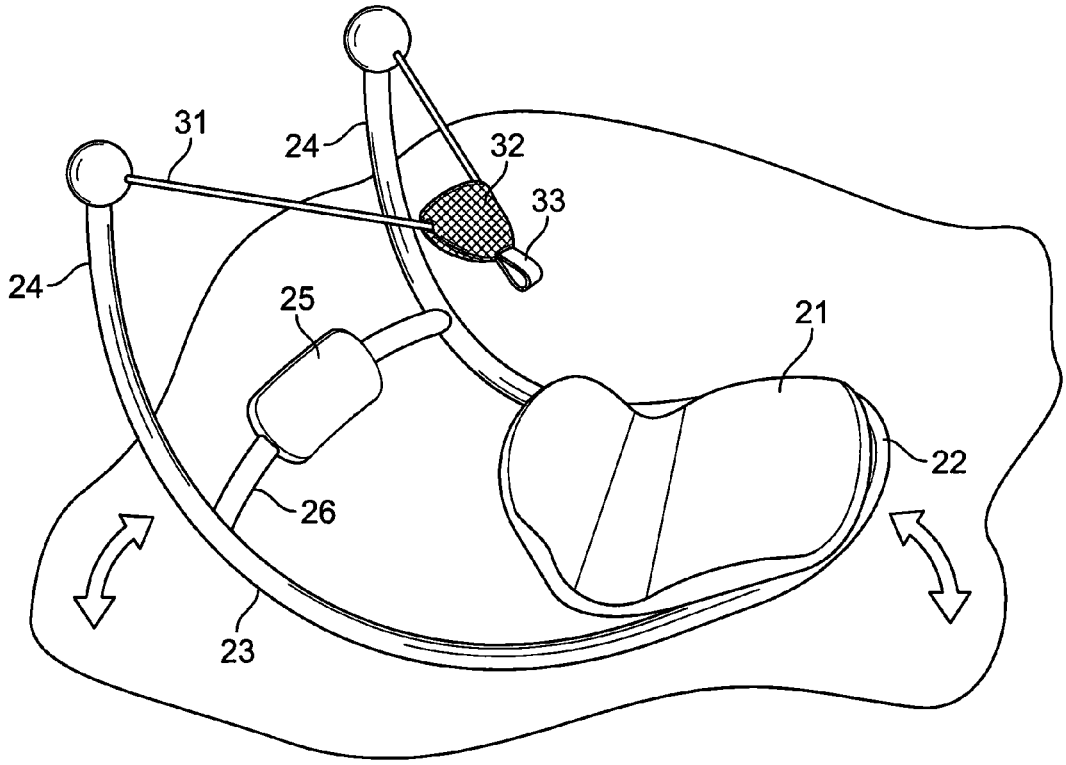
FIG. 1 is a perspective view of the slingshot seat having a rocking bottom.
Figure 2:
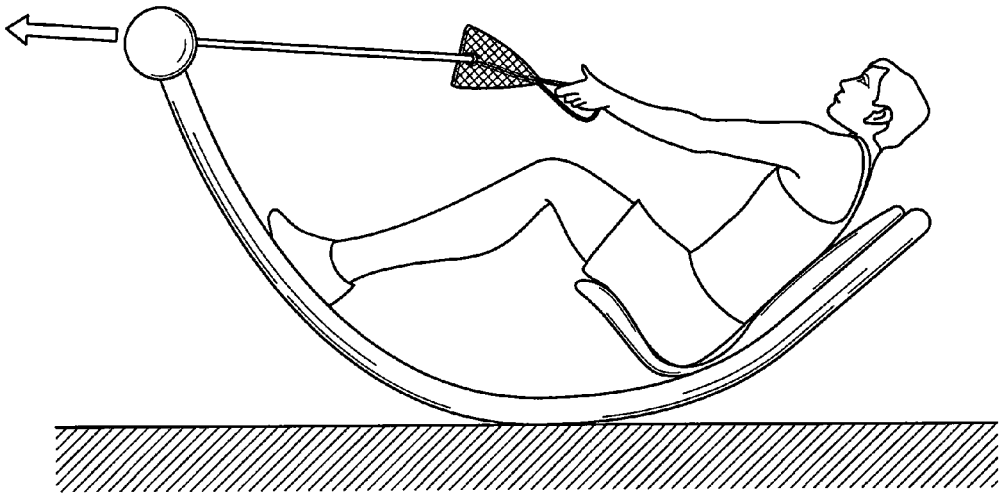
FIG. 2 is a side view of a slingshot seat showing the low angle.
Figure 3:
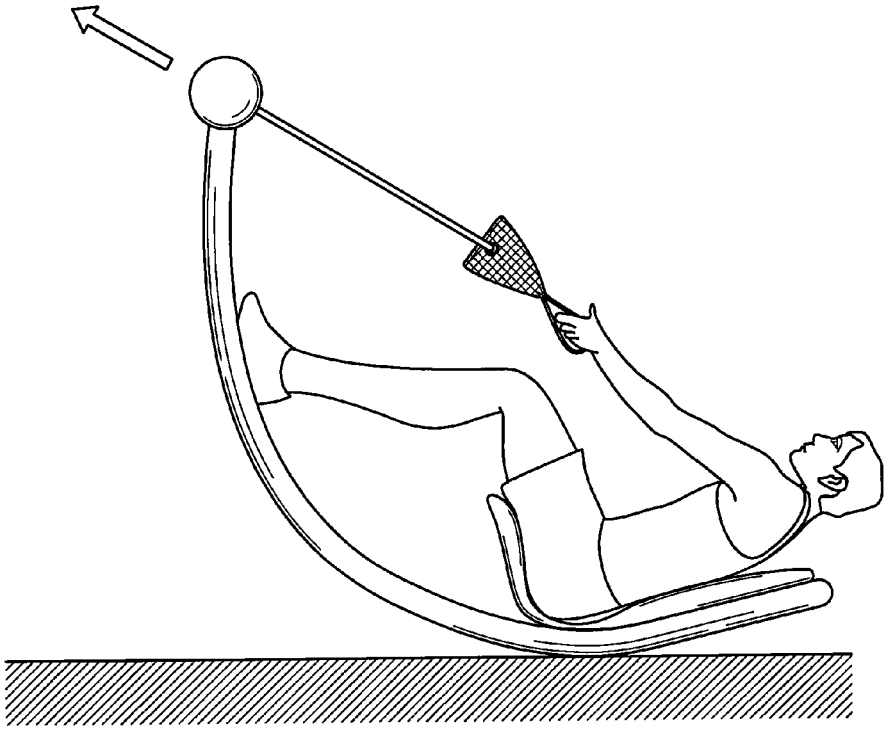
FIG. 3 is a side view of the slingshot seat showing a high angle.
Figure 4:
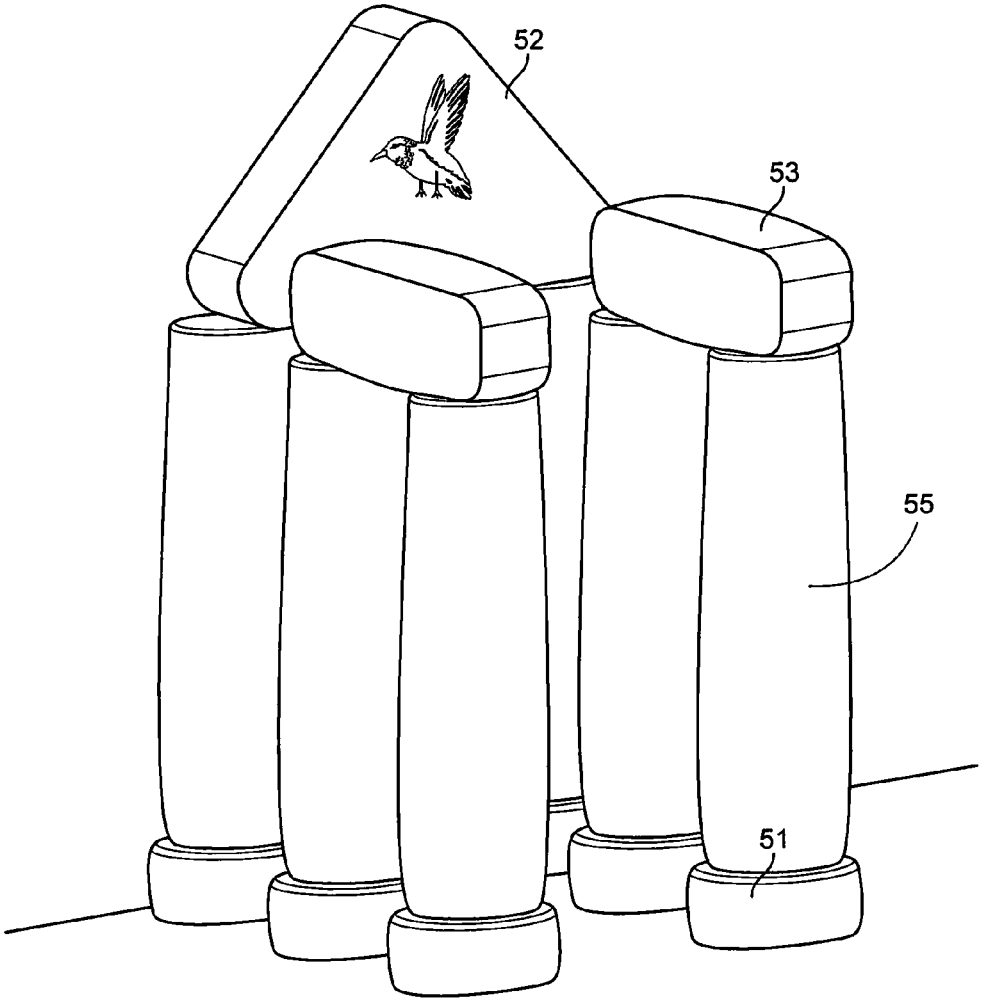
FIG. 4 is a perspective view of a target having a ring base.
Figure 5:
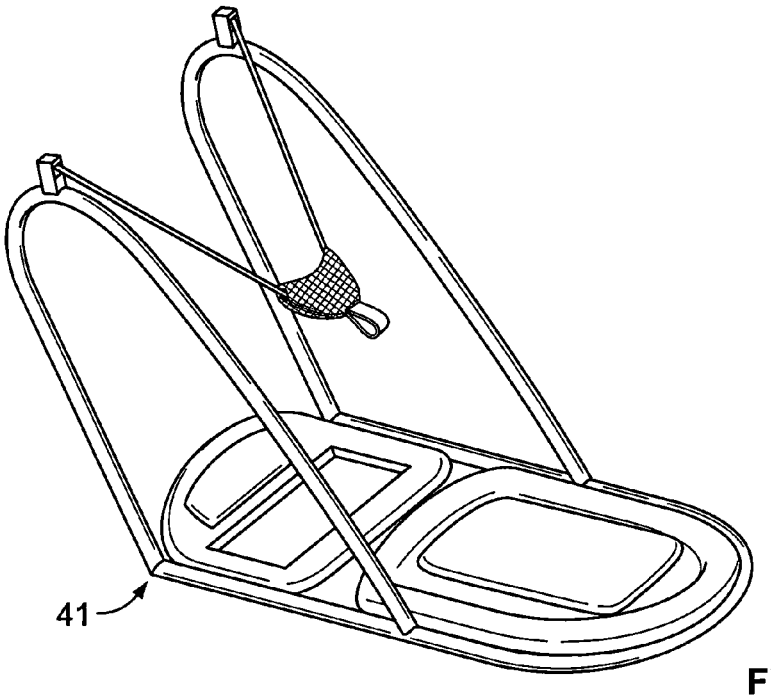
FIG. 5 is a perspective view of a flat bottom slingshot seat.
Figure 6:
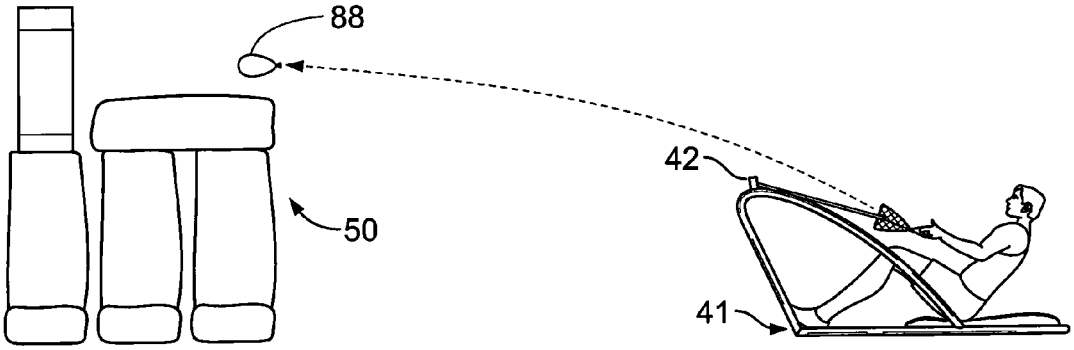
FIG. 6 is a side view of a flat bottom slingshot seat shooting at a target.
Figure 7:
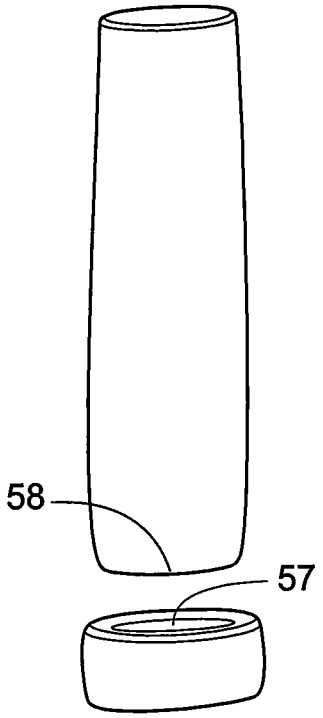
FIG. 7 is an exploded view of an inflated column member sitting on the base holder depression.

The following call out list of elements can be a useful guide in referencing the elements of the drawings.

21 Blow Molded Seat
22 Tubular Frame
23 Curved Portion
24 Upwardly Extending Arms
25 Foot Rest
26 Cross Brace
31 Elastic Cord
32 Receptacle Net
33 Strap Handle
41 Angle Corner
50 Inflatable Target
51 Base Holder
52 Inflatable Triangular Member
53 Inflatable Arch Member
55 Column Target
57 Base Holder Depression
58 Rounded Protrusion On Bottom Of Column
88 Water Balloon

DETAILED DESCRIPTION OF THE PREFERRED EMBODIMENT

The present invention has a blow molded seat 21. The user can sit on the blow molded plastic seat. The blow molded seat is connected to a tubular frame 22. The tubular frame 22 extends forward from the blow molded seat 21 on a right and left side and can also wrap around behind the blow molded seat. The tubular frame may have a circular cross-section. The frame is preferably rocker bottom on a curved portion 23. The curved portion extends to upwardly extending arms 24. The upwardly extending arms 24 extend from the tubular frame 22 and can be made of fiberglass or metal while the tubular frame is fiberglass or metal. The frame forms a rocker bottom that extends from the tubular frame 22 to the upwardly extending arms.

A foot rest 25 can be mounted between the pair of upwardly extending arms. The foot rest 25 can be mounted on a tubular metal cross brace 26. The foot rest 25 can be made as a foot rest for leaning one or both feet on the foot rest. The foot rest 25 can be made as a plank or can have economically shaped indentations for receiving shoes. The foot rest 25 can also be made of the injection molded plastic having connection to the frame. The injection molded plastic numbers such as the foot rest 25 and the blow molded seat 21 can receive screws for connection to the frame. The rest 25 may further have reinforcing numbers on a backside or underside of the foot rest 25 to provide reinforcement so that a user can leverage to tilt the slingshot back. The foot rest preferably includes a grip surface on a top side facing the user and may have a hollow portion on the underside of the foot rest. The foot rest can be connected to the metal cross brace 26 using screws.

An elastic cord 31 connects to a receptacle net 32 that can hold a projectile such as a ball or water balloon or tennis ball. A polypropylene strap can form a strap handle 33 and can provide a handle for grasping the net and pulling it back.

In an alternate embodiment the rounded bottom tubular frame can be formed as a flat bottom having a smaller radius angle corner 41 of curvature tight angle. Alternatively, the tubular frame upwardly extending arms 24 can be continued so that they bend backward and connect to the tubular frame 22. The upwardly extending arms 24 can therefore form a pair of arches 42.

The upwardly extending arms 24 are bendable and have resilient deformation. The upwardly extending arms 24 preferably include end caps that can be attached to the elastic cord 31. The elastic cord 31 can be wrapped around the end caps. The elastic cord 31 can also be tied to the end caps and retained by a retaining band or clip fitting over the end caps.

During usage, a user sits on the seat and uses the user body weight to stabilize the slingshot seat. The user can then use tilt to produce a leaning angle. The user can rock forward or backward by shifting body weight. The user can change the projectile initial angle of flight by leaning forward or backward on the rocker bottom frame.

Optionally, a mechanical slingshot release can be used to provide pushbutton release of the handle strap commonly used for slingshot pulling and for archery pulling.

Optionally, the seat can be made to slide relative to the tubular frame 22. The sliding seat can be used for adjusting to various height of users. The seat can be secured to the frame using bolts or adjustable pins extending through adjustment openings formed on the frame and on the seat. A user can remove an adjustable pin and slide the seat forward or backward and then put the adjustable pin back into the seat to secure the seat to the frame on the adjustment opening.

Preferably, the slingshot seat launches water balloons or other ball type projectiles. An inflatable target can be set up having an inflatable column standing on a ring base. An inflatable column can have a rounded bottom. The inflatable column can be stabilized on a flat ground using the ring base which supports a circumferential lower portion of the rounded bottom. The rounded bottom can be oriented with the ring base so that the rounded bottom of the inflatable column can rotate relative to the ring base. Upper portions of the inflatable column can be connected to other inflatable columns such as by stacking, or by small sections of hook and loop tape.

When the user shoots a projectile such as a water balloon 88 at the inflatable target 50, the inflatable target 50 can be knocked over and separated into individual members. Inflatable triangular members 52 can be placed on top of column targets 55. Inflatable arch members 53 can also be put on top of column targets 55. The base holder 51 has a base holder depression 57 which can extend through the thickness of the base holder 51 so that the base holder 51 is like a ring. The base holder 51 can also have a shallow depression, but enough of a depression to receive a rounded protrusion 58 formed on the bottom of a column target 55.

Although the invention has been disclosed in detail with reference only to the preferred embodiments, those skilled in the art will appreciate that various other embodiments can be provided without departing from the scope of the invention. Accordingly, the invention is defined only by the claims set forth below.

The invention claimed is:

1. A slingshot seat comprising:

a. a frame with a rocker bottom configured to provide a low trajectory and a high trajectory;

b. a seat mounted on the frame and positioned to allow a user to rock forward on the rocker bottom to a forward position of the low trajectory and positioned to allow a user to rock backward on the rocker bottom and a backward position of the high trajectory, wherein the rocker bottom is configured to rock on the ground;

c. a pair of upwardly extending arms extending from the frame, wherein the pair of upwardly extending arms terminate in a right upper end and left upper end; wherein the pair of upwardly extending arms are continued so that they bend backward and connect to the tubular frame which is a pair of arc shape rocker bottom configured to rock on the ground;

d. an elastic cord attached to the right upper end and attached to the left upper end; and e. a pocket mounted on the elastic cord between the right upper end and the left upper end.

2. The slingshot seat of claim 1, further comprising: a foot rest connected to the frame between the pair of upwardly extending arms.

3. The slingshot seat of claim 2, wherein the seat is a blow molded plastic member.

4. The slingshot seat of claim 2, further comprising: a pair of end caps, namely a left end cap and a right end cap wherein the left end cap fits over the left upper end and the right end cap fits over the right upper end.

5. The slingshot seat of claim 2, wherein the pocket further includes a pull strap for pulling back the pocket, wherein the pocket is a net pocket.

6. The slingshot seat of claim 2, wherein the pair of upwardly extending arms are continued so that they bend backward and connect to the tubular frame.

7. The slingshot seat of claim 1, wherein the seat is a blow molded plastic member.

8. The slingshot seat of claim 1, further comprising: a pair of end caps, namely a left end cap and a right end cap wherein the left end cap fits over the left upper end and the right end cap fits over the right upper end.

9. The slingshot seat of claim 1, wherein the pocket further includes a pull strap for pulling back the pocket, wherein the pocket is a net pocket.

* * * * *